US009974347B2

(12) United States Patent
Audet

(10) Patent No.: US 9,974,347 B2
(45) Date of Patent: May 22, 2018

(54) FLAME BLOCKING VENTING TRAP AND PROTECTION GARMENT THEREOF

(71) Applicant: CODET INC., Coaticook (CA)

(72) Inventor: Jean-Pierre Audet, Coaticook (CA)

(73) Assignee: CODET INC., Coaticook (CA)

( * ) Notice: Subject to any disclaimer, the term of this patent is extended or adjusted under 35 U.S.C. 154(b) by 139 days.

(21) Appl. No.: 14/096,808

(22) Filed: Dec. 4, 2013

(65) Prior Publication Data

US 2014/0157497 A1 Jun. 12, 2014

Related U.S. Application Data

(60) Provisional application No. 61/875,738, filed on Sep. 10, 2013.

(30) Foreign Application Priority Data

Dec. 10, 2012 (CA) ..... 2798649
Aug. 8, 2013 (CA) ..... 2823035

(51) Int. Cl.
*A41D 31/00* (2006.01)
*A41D 27/28* (2006.01)

(52) U.S. Cl.
CPC ..... *A41D 31/0027* (2013.01); *A41D 27/28* (2013.01)

(58) Field of Classification Search
CPC ..... A41D 27/28; A41D 2400/20; A41D 13/0158; A41D 31/0022; A41D 31/0033; A41D 31/0027; A62B 17/003; A62B 17/00; Y10S 2/01
USPC ..... 2/DIG. 1, 81, 94, 455, 458; 135/93
See application file for complete search history.

(56) References Cited

U.S. PATENT DOCUMENTS

| | | | |
|---|---|---|---|
| 2,343,477 | A | 3/1944 | Ross |
| 2,458,004 | A | 1/1949 | Kerry |
| 2,713,168 | A | 7/1955 | Vito |
| 3,045,243 | A | 7/1962 | Lash et al. |
| 3,086,215 | A | 4/1963 | Di Paola |
| 3,153,793 | A | 10/1964 | Lepore |
| 3,761,962 | A | 10/1973 | Myers |
| 3,921,224 | A | 11/1975 | Ingram, III |
| 4,267,651 | A | 5/1981 | Albano |
| 4,408,356 | A | 10/1983 | Abrams |
| 4,513,451 | A | 4/1985 | Brown |
| 4,576,087 | A | 3/1986 | Wolfe |

(Continued)

FOREIGN PATENT DOCUMENTS

| | | |
|---|---|---|
| CA | 992252 | 7/1976 |
| CA | 2798649 | 12/2012 |

(Continued)

*Primary Examiner* — Khoa Huynh
*Assistant Examiner* — Griffin Hall

(57) ABSTRACT

The application relates to a flame blocking venting trap (FBVT) adapted to vent a garment, the FBVT comprising a proximal layer; a central venting layer superposed to the proximal layer; and a distal layer superposed to the central venting layer. The the proximal layer is forming a first fold with the central venting layer and the central venting layer is forming a second fold with the distal layer to act as a flow restricting apparatus configured to prevent air and flames to get through the FBVT from the outside of the garment and allow air to get through the FBVT from the inside of the garment. A garment including one or many FBVT is encompassed by the present application.

20 Claims, 14 Drawing Sheets

(56) References Cited

U.S. PATENT DOCUMENTS 4,722,099 A * 2/1988 Kratz ..... A41D 27/28 2/115
4,731,883 A * 3/1988 Foster ..... A41D 27/28 2/247
5,172,426 A * 12/1992 Capello ..... A62B 17/003 2/227
5,357,689 A 10/1994 Awai
5,377,912 A * 1/1995 Webb ..... A62C 3/07 169/52
5,507,042 A * 4/1996 van der Slessen .... A41D 27/28 2/108
5,551,172 A 9/1996 Yu
5,642,526 A 7/1997 Thompson
5,647,150 A 7/1997 Romanato
5,704,064 A * 1/1998 van der Sleesen .... A41D 27/28 2/108
5,727,256 A 3/1998 Rudman
5,845,336 A * 12/1998 Golde ..... A41D 27/28 2/108
6,070,274 A 6/2000 van der Sleesen
6,263,510 B1 * 7/2001 Bay ..... A41D 27/28 2/108
6,665,954 B2 12/2003 Chen
6,691,317 B2 * 2/2004 Cochran ..... A41D 27/04 2/81
6,795,976 B1 9/2004 van der Sleesen
6,868,557 B1 3/2005 van der Sleesen
7,043,767 B2 5/2006 Jaeger
7,111,328 B2 9/2006 Bay
7,171,695 B2 2/2007 Braun
7,181,774 B2 2/2007 Silver
7,412,728 B2 * 8/2008 Alesina ..... A41D 27/28 2/69
7,441,351 B2 10/2008 Clark
7,540,037 B1 * 6/2009 Bittler ..... A41D 13/0543 2/69
7,966,668 B2 6/2011 Bay
7,971,283 B2 7/2011 Winterhalter
8,001,618 B2 * 8/2011 Bay ..... A41D 3/00 2/93
8,291,514 B2 * 10/2012 Waters ..... A41D 13/0002 2/101
8,464,367 B1 * 6/2013 Mordecai ..... A43B 3/02 2/22
8,713,712 B2 5/2014 Maurer
2003/0033656 A1 * 2/2003 Jaeger ..... A41D 27/28 2/69
2003/0110553 A1 * 6/2003 Aldridge ..... A41D 27/04 2/458
2004/0049942 A1 3/2004 Chen
2004/0154084 A1 * 8/2004 Aldridge ..... A41D 13/00 2/458
2005/0251900 A1 * 11/2005 Harlacker ..... A41D 31/0027 2/457
2005/0273903 A1 * 12/2005 Rudman ..... A41D 27/28 2/69
2006/0059601 A1 * 3/2006 Opitz ..... A41D 3/00 2/108
2007/0039210 A1 2/2007 Clark
2007/0094763 A1 5/2007 Silver
2007/0245443 A1 * 10/2007 Vereen ..... A41B 1/00 2/69
2008/0263743 A1 * 10/2008 Maurer ..... A41D 27/28 2/69
2008/0289077 A1 * 11/2008 Enlund ..... A41D 13/0053 2/81
2009/0178174 A1 * 7/2009 Cash, Jr. ..... A41D 1/08 2/69
2009/0265829 A1 * 10/2009 Gomes Seguin ..... A41D 3/04 2/87
2010/0146686 A1 6/2010 Winterhalter
2011/0126431 A1 6/2011 Mazzarolo
2012/0210499 A1 8/2012 Habash
2013/0031703 A1 2/2013 Curtis
2014/0157497 A1 6/2014 Audet

FOREIGN PATENT DOCUMENTS

| | | |
|---|---|---|
| CA | 2573973 | 7/2013 |
| CA | 2823035 | 8/2013 |
| DE | 3415658 | 10/1985 |
| FR | 2619997 | 3/1989 |
| GB | 2104770 | 3/1983 |

* cited by examiner

FLAME BLOCKING VENTING TRAP AND PROTECTION GARMENT THEREOF

CROSS-REFERENCES

The present application is a non-provisional application of, and claims priority under 35 U.S.C. 119(e) to, U.S. patent application No. 61/875,738, filed Sep. 10, 2013, entitled FLAME BLOCKING VENTING TRAP AND PROTECTION GARMENT THEREOF, which is incorporated herein by reference, and which claims priority under 35 U.S.C. 119(a) to, Canadian patent application no. 2,798,643, filed Dec. 10, 2012, entitled COMBINAISON VENTILER, and to, Canadian patent application no. 2,823,035, filed Aug. 8, 2013, entitled TRAPPE D'AÉRATION IGNIFUGE, which are incorporated herein by reference in their entireties.

BACKGROUND OF THE INVENTION

1. Field of the Invention

This invention generally relates to a flame blocking venting trap adapted to be installed on, or be incorporated in, a safety garment. The present invention more specifically relates to a flame blocking venting trap adapted to allow air venting while preventing flames to get through the suit and reach the skin of a wearer of the garment.

2. Description of the Related Art

Protection garments have been used for many purposes against many environmental factors like oil, gas, grease dirt, solvent, chemicals, water and biohazard, among others. Workers performing tasks associated with significant fire hazards can also use them. For instance, they can be used in the gas and oil industries where the likelihood of fire blast, or flash fire, is present.

Protection garments can come in a variety of configurations. Shirts and pants can be used individually or collectively to protect a worker in accordance with the specifics of the tasks to accomplish. The protection garment can also be a one-piece article of clothing commonly called a coverall. A coverall is usually a loose fitting garment comprising a trouser-like portion and top portion, with or without sleeves, that is usually worn over casual clothing.

The material used in a protection garment is often rugged or intrinsically prevents air to pass therethrough because of its technical and protective properties. Venting in a protection garment has therefore a significant importance to prevent overheating of the wearer. Flexibility and comfort can also be challenging given the nature and the stiffness of the material.

It is therefore desirable to provide a flame blocking ventilation trap on a protection garment that allows ventilation therethrough while preventing flames to get through the ventilation trap.

It is desirable to provide an improved protection garment over the existing art that allows ventilation while preventing flames to get therethrough.

It is desirable to provide an improved ventilation trap over the existing art that can be easily assembled to the fabric of a safety garment and allows ventilation while preventing flames to get therethrough.

It is desirable to provide an improved ventilation trap over the existing art that has a reduced thickness and is easily assembled to the fabric without causing significant local rigidity to the safety garment.

It is desirable to provide an improved ventilation trap over the existing art that uses, in part, the same fabric as the material used in the safety garment and allows ventilation while preventing flames to get therethrough.

It is also desirable to provide an improved protection garment over the existing art that improves flexibility of the garment while allowing air circulation and prevents flames to pass through the garment and contact the skin of the wearer.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention relates to the fields of sewing techniques, patterns and clothing especially fireproof safety clothing. In order to improve the often unbearable working conditions for workers having to be equipped with an integral fireproof coverall or any other flame retardant protective clothing and having to be exposed to intense heat and even flames, and to allow for the air flow inside the suit or the garment to ease the worker's condition while preserving the integrity and safety of the suit or garment and insure that the user retain all the safety to perform his duty, the invention provides a flame blocking venting trap affixed on a fireproof clothing allowing for a natural convection system, facilitating the heat evacuation and the fresh air input through the activation by the natural movements while ensuring the user's protection with its flame blocking design. The preferred embodiments of the invention meet safety standards NFPA 2112 regarding flame-resistant garments for protection of industrial personnel against flash fire, and ASTM standards regarding performance for textile materials for wearing apparel for use by electrical workers exposed to momentary arc and related thermal hazards. In accordance with one or more embodiments of the invention, a fireproof mesh is sandwiched between two pieces of fireproof textile each comprising a wall of the garment.

The invention is generally described as a flame blocking ventilation trap and a garment including the flame blocking ventilation trap therein. For facilitating the reading of the application, flame blocking ventilation trap is going to be referred to below as "FBVT".

Aspects of our work, in accordance with at least one embodiment, provide a FBVT that allows ventilation while preventing flames to get therethrough. In particular, a flame retardant protective garment has a plurality of vents for ventilation of a wearer. Each vent comprises a flame retardant proximal fabric layer; a central venting layer connected to the proximal fabric layer by an internal fold; and a flame retardant distal fabric layer connected to the central venting layer by an external fold. The central venting layer comprises a mesh portion that is made from a first flame retardant material, that is configured to allow a flow of air to pass therethrough, and that is located between the external fold and the internal fold. The central venting layer also comprise an internal extension fabric portion that is made from a second, non-mesh flame retardant textile material that is different from the first material, and that extends from the mesh portion to the internal fold. The proximal fabric layer is interconnected with and made from the same flame retardant textile material as the internal extension fabric portion, the internal fold comprising a defined fold in the flame retardant textile material of the proximal fabric layer and the internal extension fabric portion. Similarly, the central venting layer preferably comprises an external extension fabric portion that is made from the second, non-mesh flame retardant textile material and that extends from the mesh portion to the external fold. The distal fabric layer also preferably is interconnected with and made from the same flame retardant textile material as the external extension fabric portion, and the internal fold preferably comprises a defined fold in the flame retardant textile material of the distal fabric layer and the external extension fabric portion. When the vent is in a closed position, the central venting layer is sandwiched between the flame retardant proximal fabric layer and the flame retardant distal fabric layer. The flame retardant protective garment preferably has a first vent that extends along a right-rear side of the garment and a second vent that extends along a left-rear side of the garment. In a variation thereof, two vents extend end-to-end along the right-rear side of the garment, and two vents extending end-to-end along the left-rear side of the garment. Preferably the garment is a one-piece coverall and further comprises a vent that extends across a rear mid-portion of a right leg of the coverall, and a vent that extends across a rear mid-portion of a left leg of the coverall.

Aspects of our work, in accordance with at least one embodiment, provide a FBVT that allows ventilation while preventing flames to get therethrough.

Aspects of our work, in accordance with at least one embodiment, provide a FBVT in a safety garment that allows ventilation of the garment while preventing flames to get therethrough.

Aspects of our work, in accordance with at least one embodiment, provide a FBVT that can be easily assembled to the fabric of a safety garment and allows ventilation while preventing flames to get therethrough.

Aspects of our work, in accordance with at least one embodiment, provide a FBVT that has a reduced thickness and is easily assembled to the garment without causing significant local increased rigidity of the safety garment.

Aspects of our work, in accordance with at least one embodiment, provide a FBVT that uses, in part, the same fabric as the material used for the safety garment and allows ventilation while preventing flames to get therethrough.

Aspects of our work, in accordance with at least one embodiment, provide a FBVT adapted to be restricted, or closed, when an external pressure is applied thereon and to open when the external pressure is removed.

Aspects of our work, in accordance with at least one embodiment, provide a FBVT having a "Z" shape adapted to route a flame blast from circulating through an opening in the FBVT.

Aspects of our work, in accordance with at least one embodiment, provide a FBVT having a double-fold "Z" shaped layout including a distal layer of material, a central layer of air permeable material (e.g. mesh) and a proximal layer of material adapted to route a flame blast from circulating through an opening in the FBVT.

Aspects of our work, in accordance with at least one embodiment, provide a FBVT configured to allow air ventilation of the garment while blocking flames to get through the garment.

Aspects of our work, in accordance with at least one embodiment, provide a FBVT configured to close an opening thereof when a flow of air reaches the FBVT from the exterior to prevent air to get through the garment through the FBVT.

Aspects of our work, in accordance with at least one embodiment, provide a garment comprising a FBVT therein.

Aspects of our work, in accordance with at least one embodiment, provide a FBVT including a mesh portion extending with a pair of non-mesh portions extending on respective sides of the mesh portion.

Aspects of our work, in accordance with at least one embodiment, provide a FBVT including a mesh portion extending with a non-mesh portions extending on a side of the mesh portion.

Aspects of our work, in accordance with at least one embodiment, provide a FBVT including a mesh portion extending with a non-mesh portions extending on a side of the mesh portion. Each non-mesh portion interconnecting a fabric portion via a fold.

Aspects of our work, in accordance with at least one embodiment, provide a FBVT including a first layer of fabric superposed over a layer of mesh portion, that is disposed over a second layer of fabric.

Aspects of our work, in accordance with at least one embodiment, provide a FBVT including, sequentially, a first layer of fabric, mesh portion, and a second layer of fabric.

Aspects of our work, in accordance with at least one embodiment, provide a FBVT including a mesh portion comprising a central mesh extended by at least one non-mesh portion.

Aspects of our work provide kit comprising a plurality of FBVTs adapted to be secured or sewed to a garment.

Aspects of our work provide a FBVT that complies with safety requirement NFPA 2112 and ASTM international requirement F1505.

Aspects of our work provide a flame blocking venting trap (FBVT) adapted to vent a garment, the FBVT comprising a proximal layer; a central venting layer superposed to the proximal layer; and a distal layer superposed to the central venting layer.

Aspects of our work provide a garment comprising a flame blocking venting trap (FBVT) adapted to vent the garment, the flame blocking coverall comprising a proximal layer; a central venting layer superposed to the proximal layer; and a distal layer superposed to the central venting layer.

Each of the embodiments of the present invention has at least one of the above-mentioned objects and/or aspects, but does not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Our work is now described with reference to the figures. In the following description, for purposes of explanation, numerous specific details are set forth in order to provide a thorough understanding of the present invention by way of embodiment(s). It may be evident, however, that the present invention may be practiced without these specific details.

Figure 1:
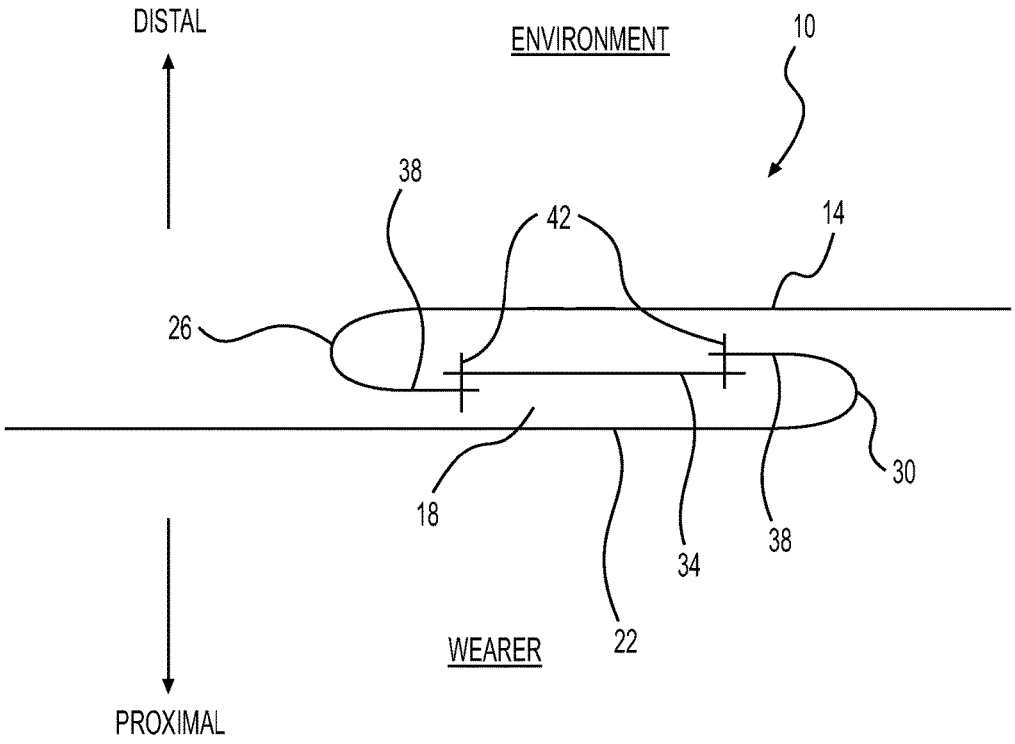
FIG. 1 is a schematic illustration of an FBVT in accordance with an embodiment of the invention.

A schematic FBVT 10 is illustrated in FIG. 1 in accordance with an embodiment of the invention. The FBVT 10 comprises a distal fabric layer 14, a central venting layer 18 and a proximal fabric layer 22. The distal fabric layer 14 is interconnected with the central venting layer 18 with an intervening external curve, or fold 26, and the central venting layer 18 is interconnecting the proximal fabric layer 22 with an intervening internal curve, or fold 30. The central venting layer 18 further includes a mesh portion 34 and extension fabric portions 38. The central venting layer 18 can be made of a single part including a portion adapted to allow an air passage thereof and can alternatively be made of an assembly of different types of fabrics and mesh. FIG. 1 illustrates an assembled central venting layer 18 where different materials 34, 38 are secured with stitches 42 or any other means adapted to secure materials together with sufficient strength (e.g. Velcro™, glue, . . . ).

Figure 2:
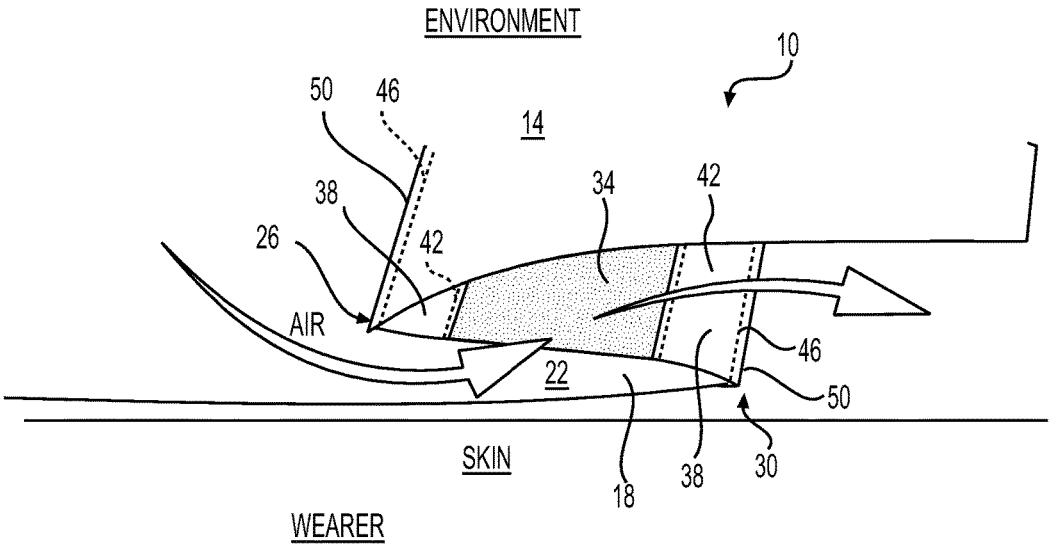
FIG. 2 is a schematic illustration of an FBVT in accordance with an embodiment of the invention with air passing therethrough from the exterior of the garment.
Figure 3:
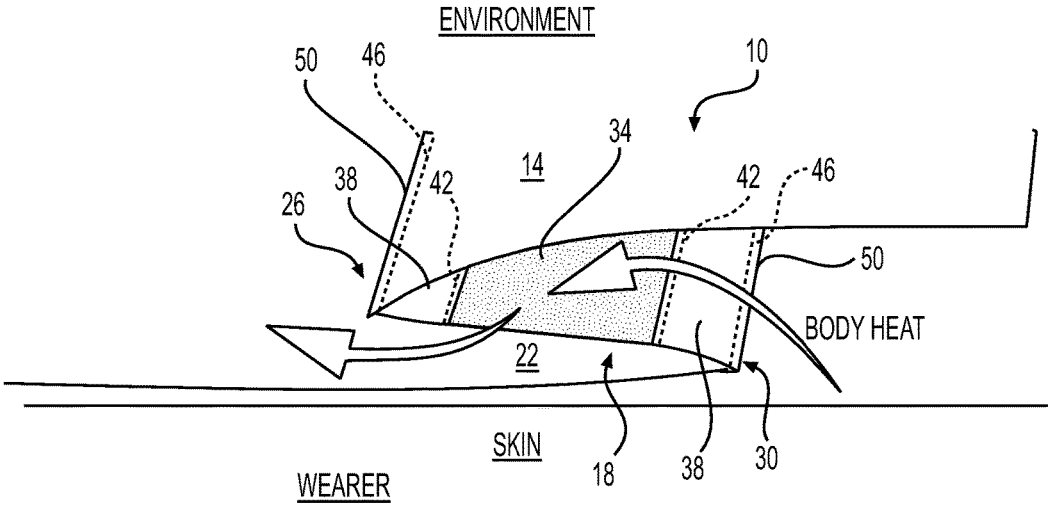
FIG. 3 is a schematic illustration of an FBVT in accordance with an embodiment of the invention with air passing therethrough from the interior of the garment.

A typical flow of air through the FBVT 10 is illustrated in FIG. 2. The flow of air is channeled from the environment between the central venting layer 18 and the proximal fabric layer 22 to pass through the mesh portion 22 and continue between the central venting layer 18 and the distal fabric layer 14 to reach the interior side of the FBVT 10 to vent the wearer of the safety garment. FIG. 3 illustrates the opposite body heat transfer from the interior side of the FBVT 10 to the environment under normal circumstances. One can also appreciate that the FBVT 10 has sort of a "Z" shape (or "S" shape) with well-defined folds 26, 30 thereof to produce a path of fabric adapted to channel air thereof. A flow of air from the inside of the garment tends to open the FBVT. The FBVT, in the present embodiment, includes additional seams 46 next to the edges 50 of the FBVT 10 to form folds. Well-defined folds 26, 30 could alternatively be made by pressing or gluing, thermo-forming the material in the desired shape. Other means to form the material can become apparent to a skilled reader and remain within the scope of the present invention.

It will further be appreciated with reference to the "Z" or "S" shaped cross-sectional configuration generally formed by the layers of the vent, the proximal fabric layer forms a bottom portion of the cross-sectional configuration, the distal fabric layer forms an upper portion of the cross-sectional configuration, the venting layer forms a diagonal portion of the cross-sectional configuration, the external fold represents an intersection of the upper portion and the diagonal portion of the cross-sectional configuration, and the internal fold represents an intersection of the lower portion and the diagonal portion of the cross-sectional configuration.

Figure 4:
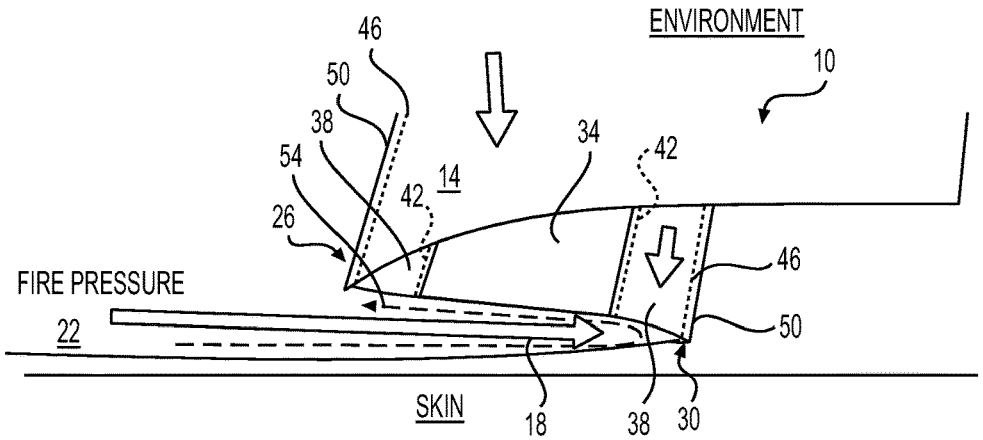
FIG. 4 is a schematic illustration of an FBVT in accordance with an embodiment of the invention with flame pattern thereof.
Figure 5:
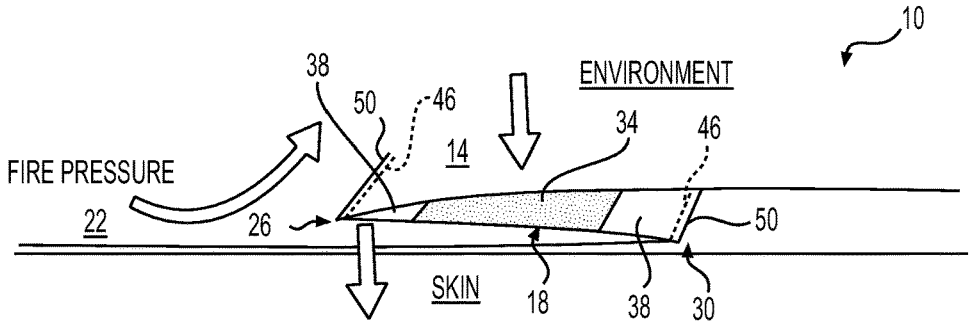
FIG. 5 is a schematic illustration of an FBVT in accordance with an embodiment of the invention with flame pattern thereof.
Figure 6:
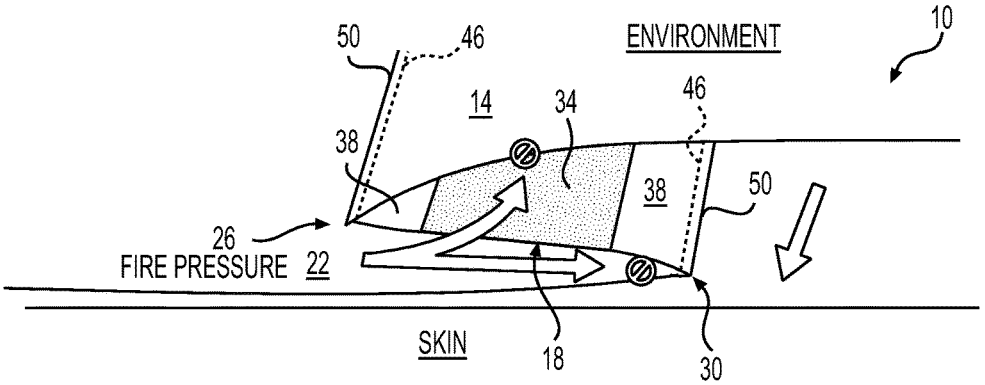
FIG. 6 is a schematic illustration of an FBVT in accordance with an embodiment of the invention with flame pattern thereof.

The FBVT 10 acts differently when a flame blast reaches the FBVT 10 from the environment. FIG. 4 illustrates that the FBVT 10 protects from flames hitting the FVBT 10 from the environment by compressing the layers 14, 18, 22 of the FBVT 10 that, in turn, is going to close the FBVT 10 as illustrated in FIG. 5 and thus prevent the flames to get through the FBVT 10 with the fire pressure. A flow of air from the outside of the garment 66 thus tends to close the FBVT. The FBVT 10 can also reacts differently if the flame blast comes parallel with the layer 22. The extension fabric portion 38 next to the internal edge 50 prevents the flame to be directed through the mesh portion 34 and redirects the flame in the opposite direction 54. The configuration of the FBVT 10 also prevents any direct contact with the skin of a wearer as illustrated in FIG. 6. One can appreciate from FIG. 6 that a flame would pass through the mesh portion 34 to hit the distal fabric layer 14 or be confined in the internal fold 50 thus providing an additional safety protection should a flame reaches the mesh portion 34.

Figure 7:
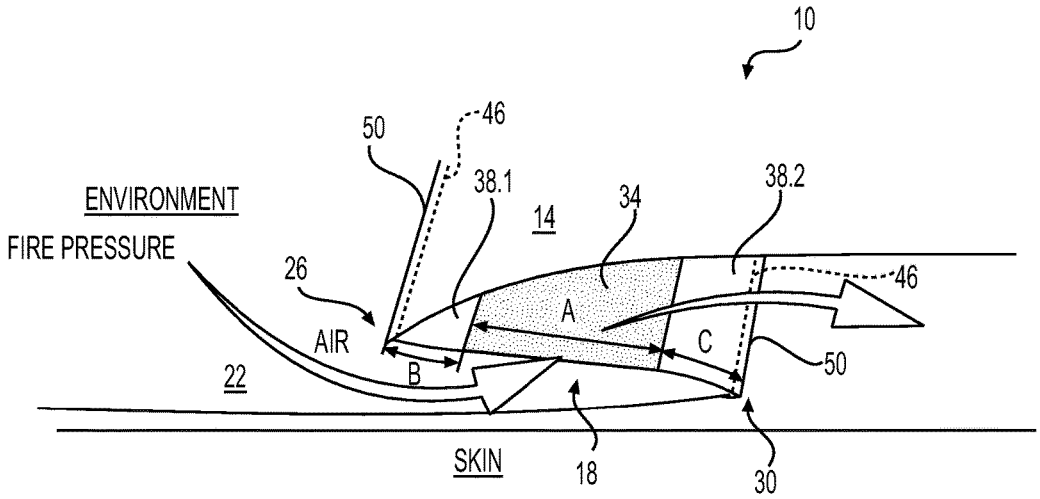
FIG. 7 is a schematic illustration of an FBVT in accordance with an embodiment of the invention with air flow pattern thereof.
Figure 8:
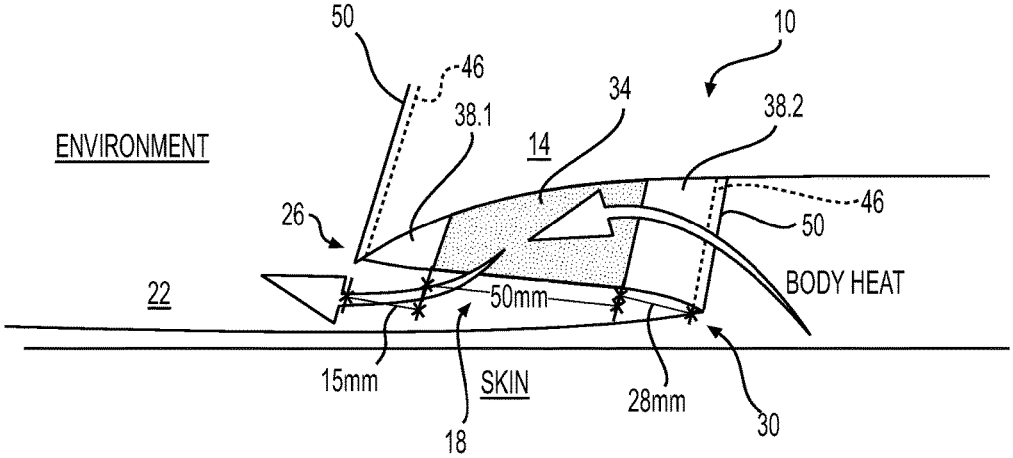
FIG. 8 is a schematic illustration of an FBVT in accordance with an embodiment of the invention with air flow pattern thereof.

FIG. 7 depicts embodiment of lengths ratios of mesh portion 34 in respect with extension fabric portions 38.1, 38.2. In an embodiment, the length A of the mesh portion 34 can vary between 10 mm and 100 mm, the length B of the extension fabric portion 38.1 can vary between 0 mm and 50 mm and finally the length C of extension fabric portions 38.2 can vary between 0 mm and 50 mm. Preferably, the length A of the mesh portion 34 can vary between 25 mm and 75 mm, the length B of the extension fabric portion 38.1 can vary between 0 mm and 30 mm and finally the length C of extension fabric portions 38.2 can vary between 10 mm and 40 mm. More preferably, the length A of the mesh portion 34 can vary between 40 mm and 60 mm, the length B of the extension fabric portion 38.1 can vary between 10 mm and 25 mm and finally the length C of extension fabric portions 38.2 can preferably vary between 20 mm and 35 mm. Other lengths can also be used depending of the design of the garment and the specific venting requirement. The lengths ratios can change depending of the size and design of the FBVT 10 and can be about (0@1)B for (2@5)A for (0@3)C, preferably about (0@1)B for (3@5)A for (1@3)C, and more preferably about (1)B for (4)A for (2)C (1B:4A:2C). FIG.8 depicts an embodiment with more precise lengths to illustrate one of the preferred embodiments.

Figure 9:
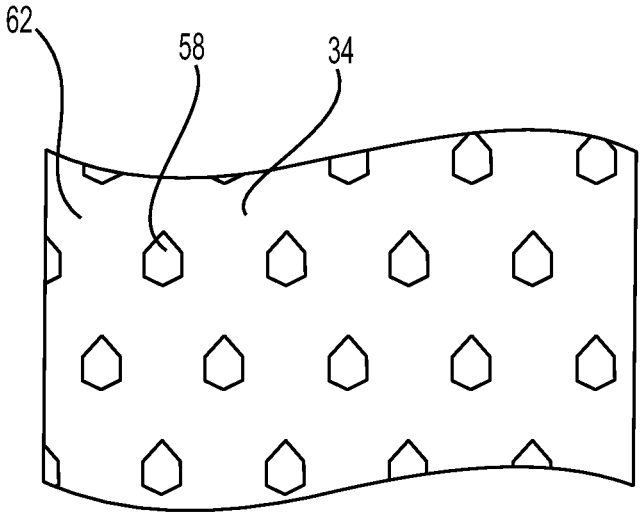
FIG. 9 is a schematic illustration of an exemplary mesh portion in accordance with an embodiment of the invention.

Turning now to FIG. 9 illustrating an exemplary mesh portion 34 in accordance with an embodiment of the invention. The mesh portion 34 is provided with a series of holes or openings 58 adapted to let air pass therethrough. The remaining portion of the mesh portion 34 is fabric material 62 adapted to provide mechanical strength to the mesh portion 34.

Figure 10:
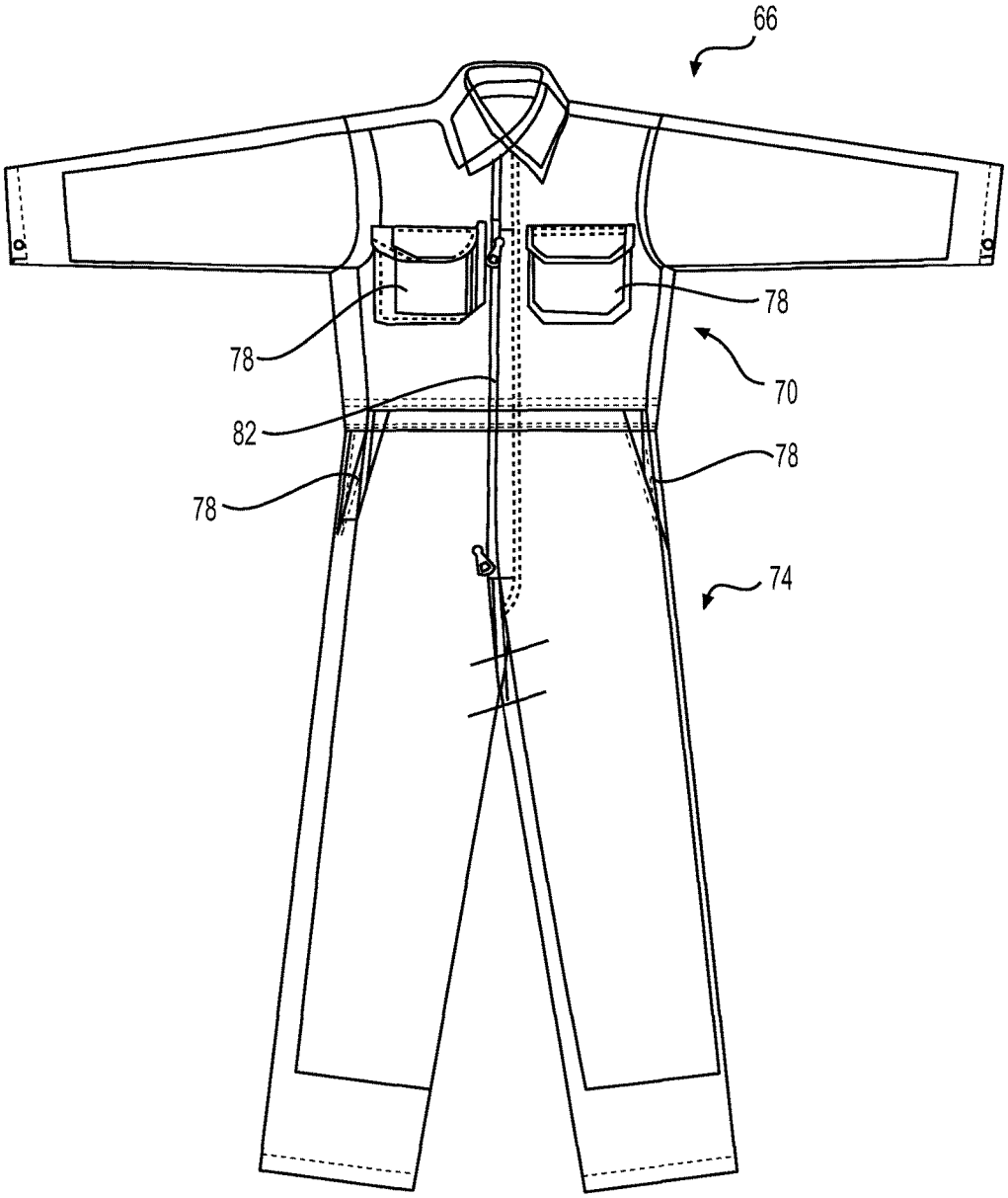
FIG. 10 is a schematic illustration of a front view of a coverall protection garment in accordance with an embodiment of the invention.
Figure 11:
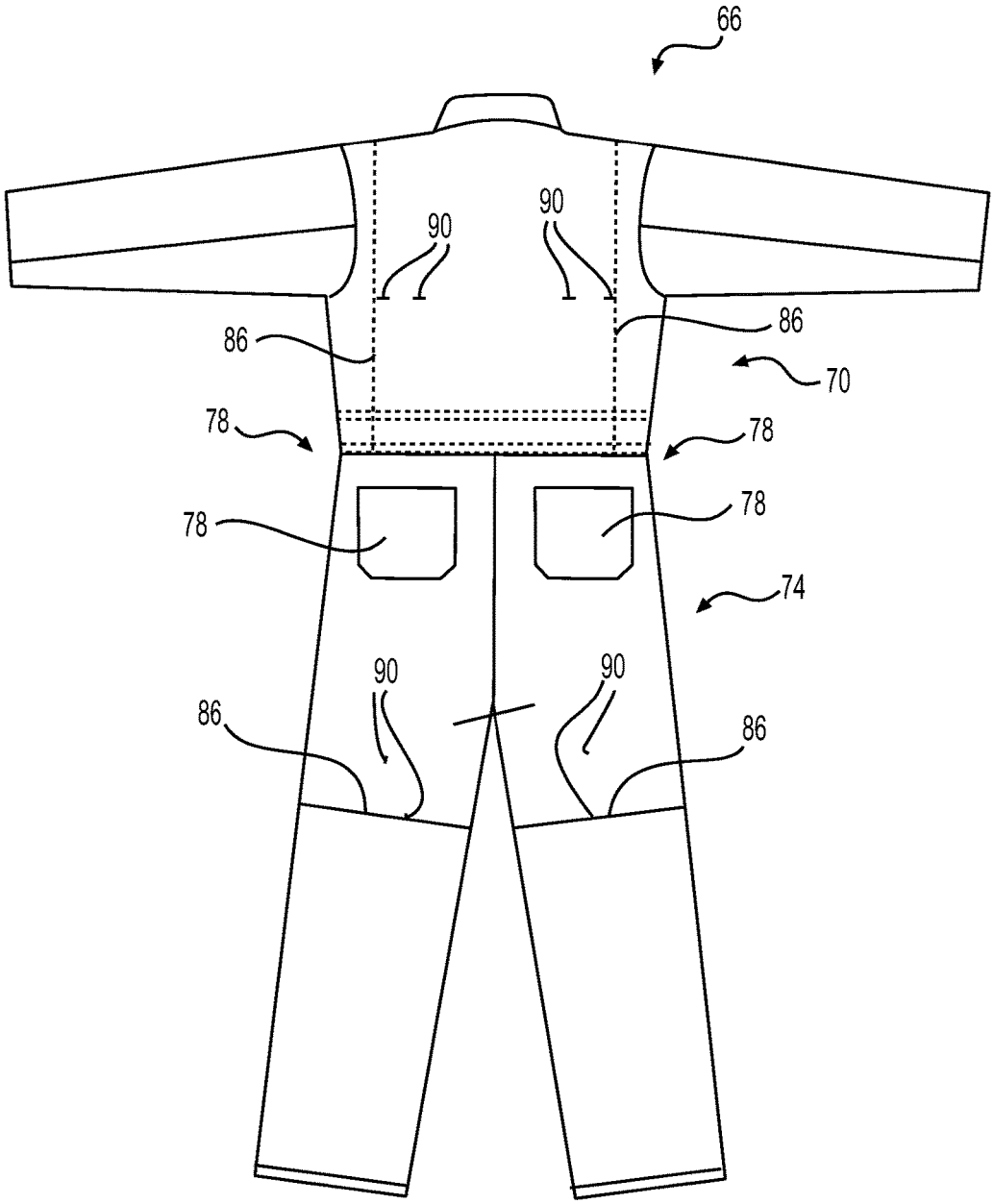
FIG. 11 is a schematic illustration of a rear view of a coverall protection garment in accordance with an embodiment of the invention.

A protection garment 66 is schematically illustrated in FIG. 10 in a front view. The protection garment 66 includes an upper portion 70 and a lower portion 74 that can be used independently or collectively. An assembled upper portion 70 and lower portion 74 can be called a one-piece coverall. The illustrated protection garment 66 includes pockets 78 and a zipper 82, or a securing means, to secure the protection garment on a wearer. FIG. 11 is a back view of the protection garment 66 of FIG. 10. One can appreciate from FIG. 11 possible venting zones 86 on the protection garment 66 where a FBVT 10 can be located. FBVT 10 can be disposed vertically and horizontally on the protection garment 66. The FBVT 10 can be located in the region of an articulation to help open the FBVT 10 with the movements of a wearer. One can appreciate that restrictors 90 are located between the distal layer 14 and the proximal layer 22 to secure the three layers 14, 18, 22 together and set a maximum opening of the FBVT 10 thus preventing excessive opening of the FBVT 10. The number, the location and the size of the restrictors 90 can vary while remaining within the scope of the invention.

Figure 12:
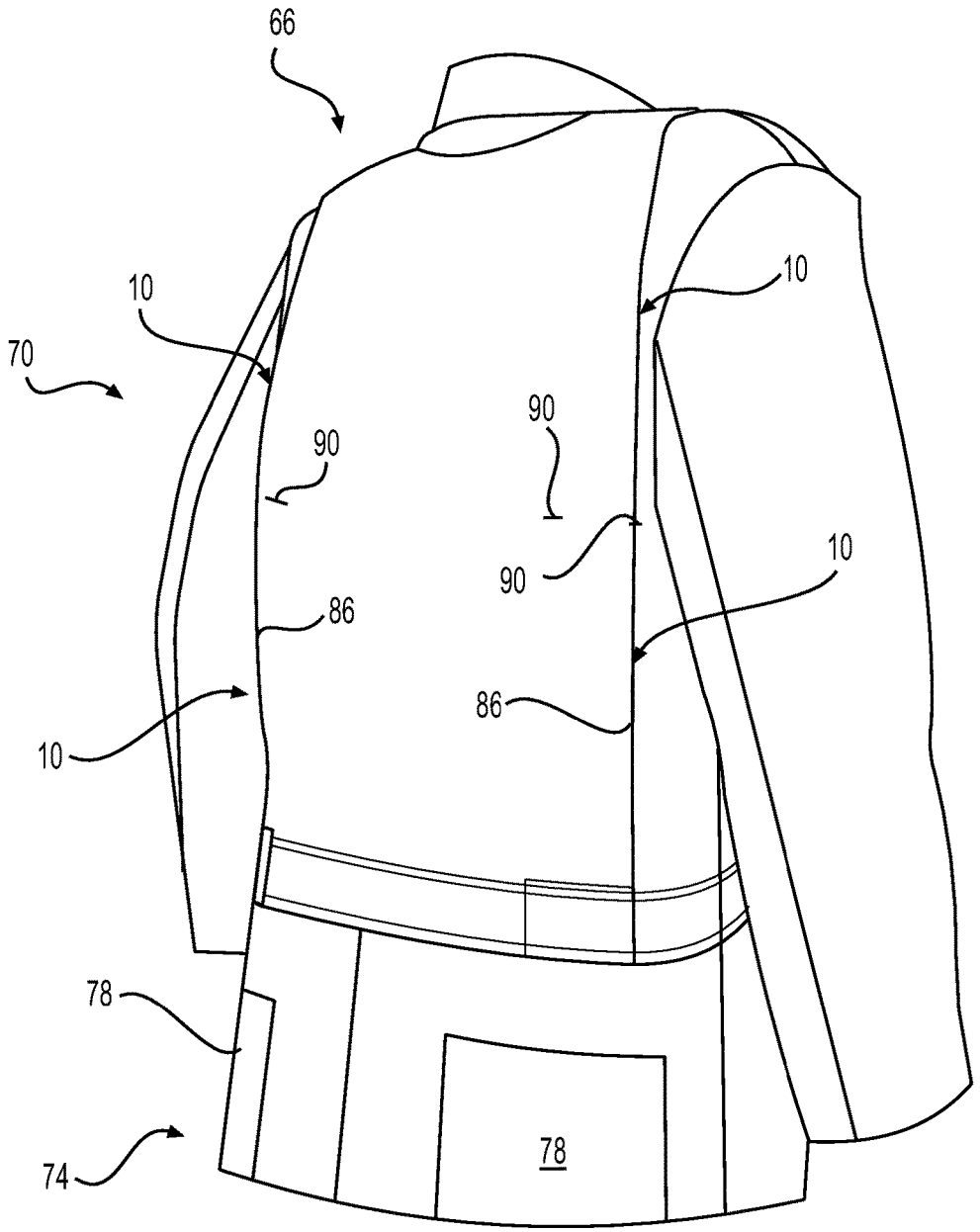
FIG. 12 is a schematic illustration of a right-rear view of a protection garment in accordance with an embodiment of the invention.
Figure 13:
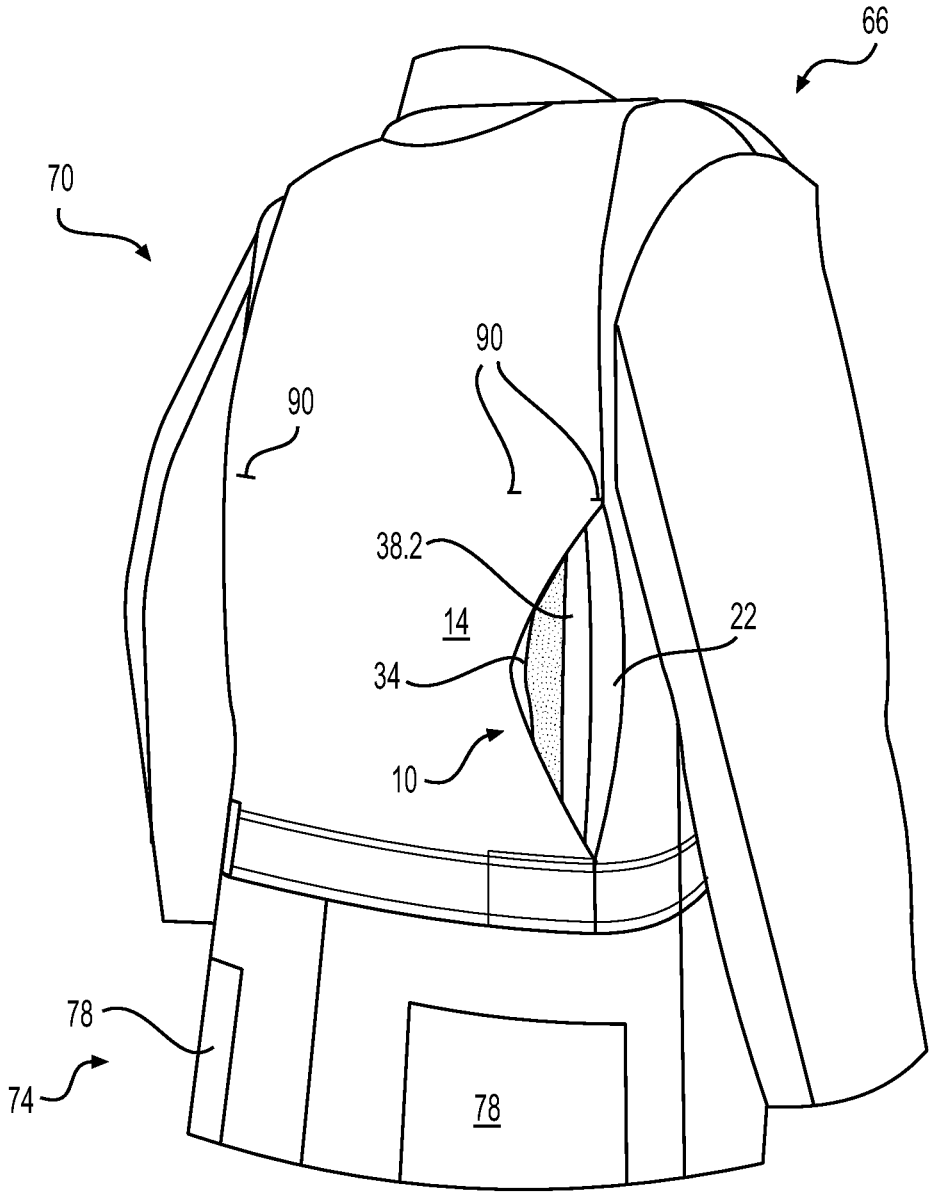
FIG. 13 is a schematic illustration of a right-rear view of a protection garment in accordance with an embodiment of the invention.
Figure 14:
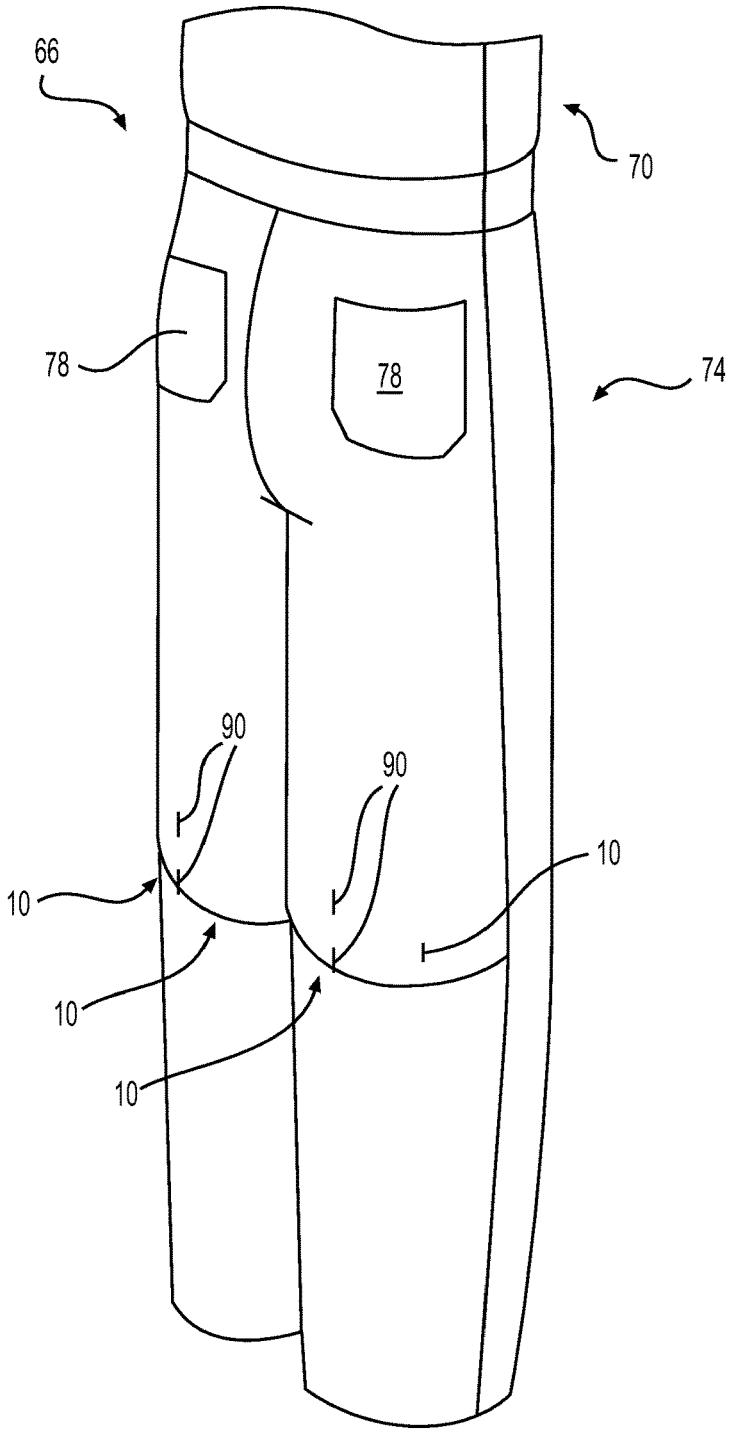
FIG. 14 is a schematic illustration of a right-rear view of a protection garment in accordance with an embodiment of the invention.
Figure 15:
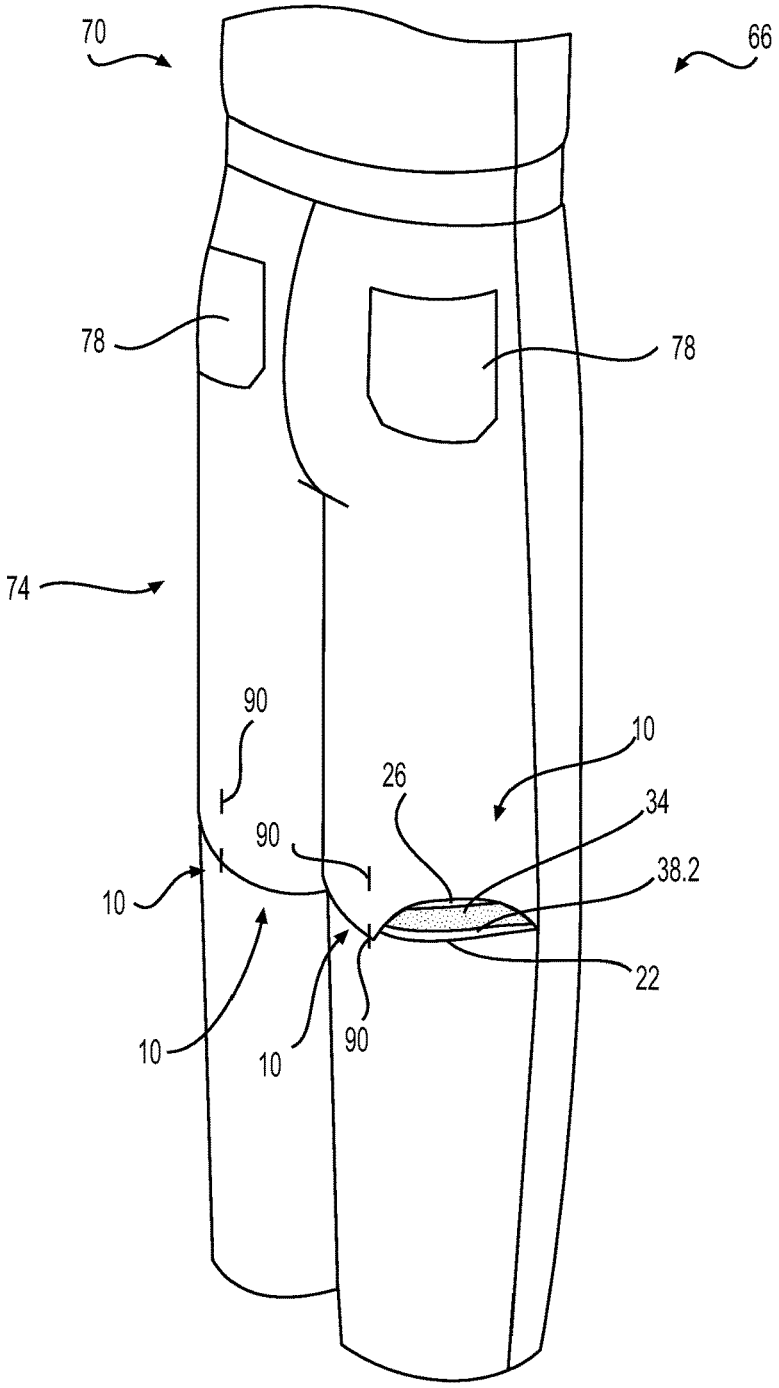
FIG. 15 is a schematic illustration of a right-rear view of a protection garment in accordance with an embodiment of the invention.
Figure 16:
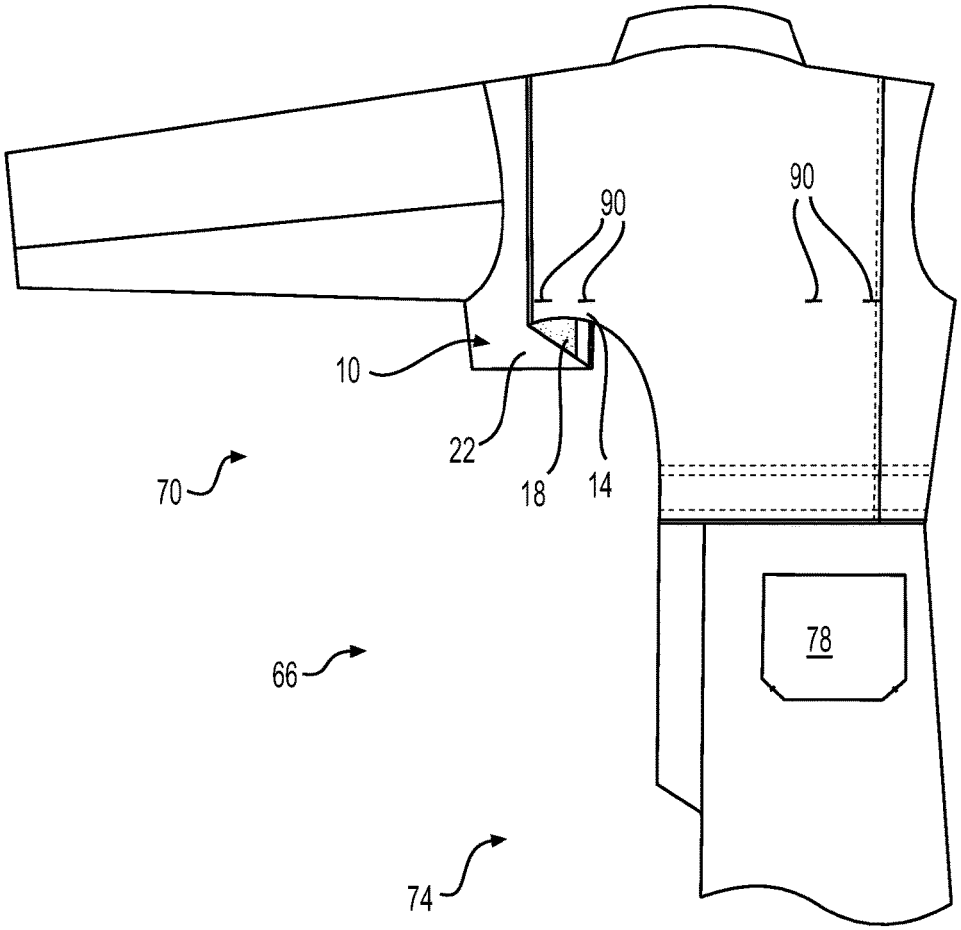
FIG. 16 is a schematic illustration of a partial section view of a rear portion of a protection garment in accordance with an embodiment of the invention.
Figure 17:
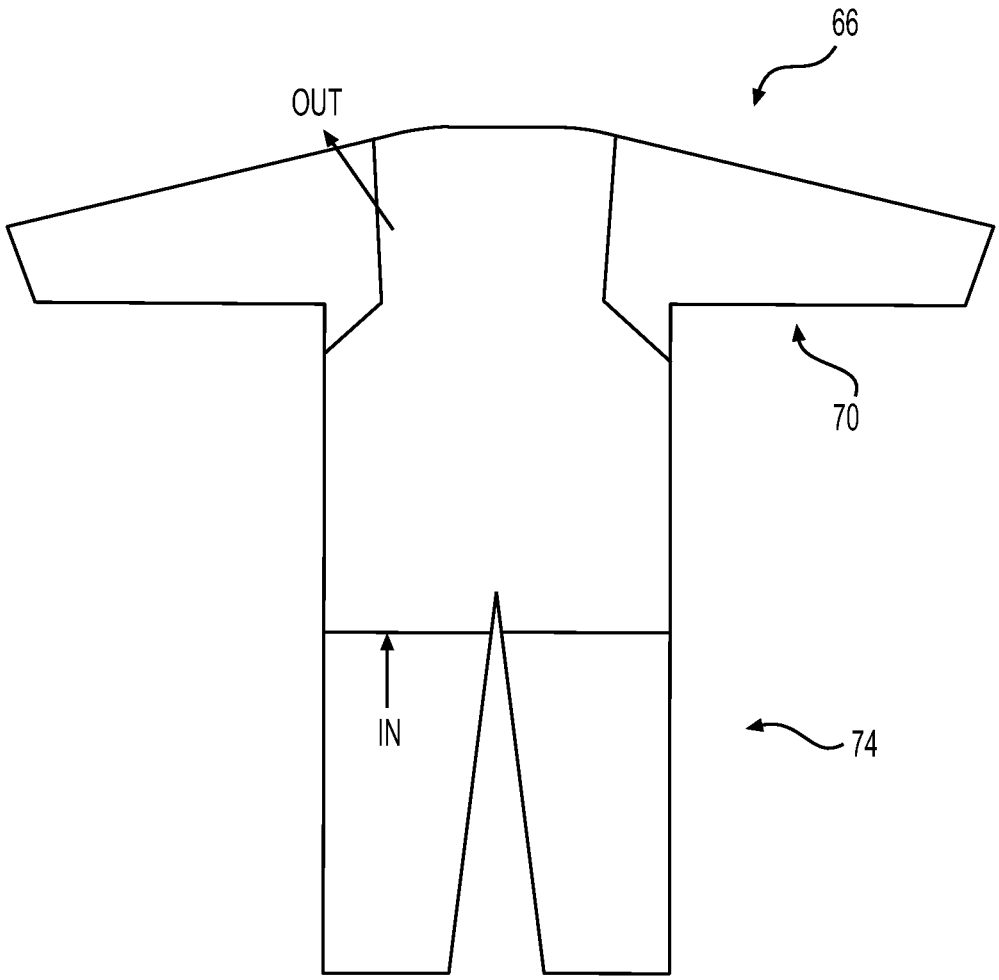
FIG. 17 is a schematic illustration of a rear portion of a protection garment in accordance with an embodiment of the invention with an air flow pattern thereof.
Figure 18:
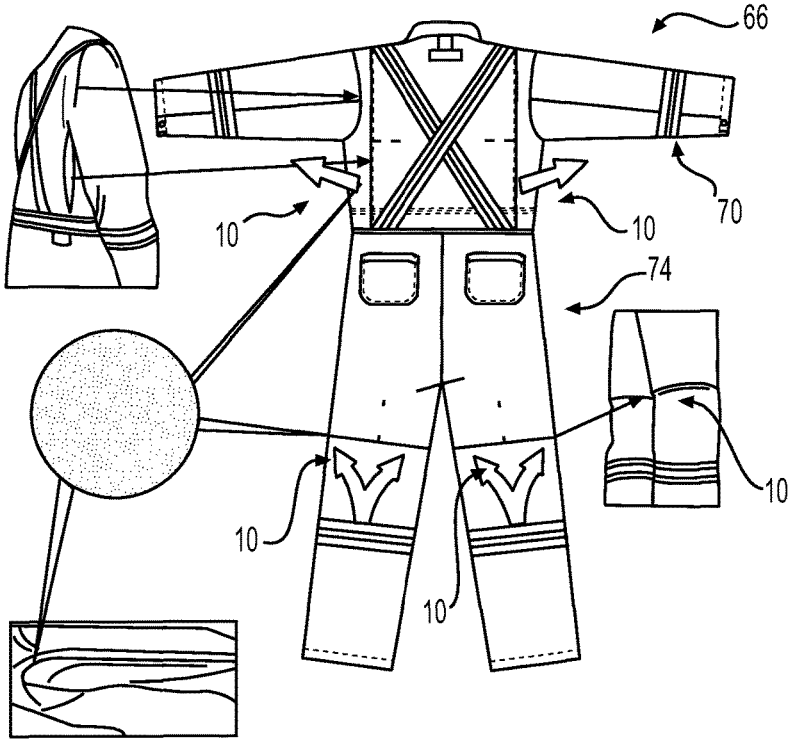
FIG. 18 is an illustration of a commercial embodiment of the present invention.

A FBVT 10 is located on the upper portion 70 of the protection garment 66 in a closed position, as seen in FIG. 12, and in an open position as seen in FIG. 13. A FBVT 10 is located on the lower portion 74 of the protection garment 66, behind the knee and is depicted in a closed position in FIG. 14 and in an open position in FIG. 15. A long FBVT 10 is illustrated and its opening is controlled by its associated restrictor 90. Two or more shorter FBVT 10 could alternatively be used instead of a long FBVT 10 without departing from the scope of the invention. FIG. 16 illustrates a sectional view of a FBVT 10 on the upper portion 70 of the safety garment 66 to appreciate its configuration in more details. FIG. 17 depicts a cooling flow of air between two FBVT 10 in accordance with another embodiment of the invention using collectively a plurality of FBVT 10 to vent a protection garment 66. And finally, FIG. 18 provides another view of a convected coverall 70 equipped with a plurality of FBVT 10 in accordance with an embodiment of the invention.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A flame retardant protective garment having a vent for ventilation of a wearer, comprising:

(a) a flame retardant proximal fabric layer;

(b) a central venting layer connected to the proximal fabric layer by an internal fold; and (c) a flame retardant distal fabric layer connected to the central venting layer by an external fold;

(d) wherein the central venting layer comprises:

(i) a mesh portion that is made from a first flame retardant material, that is configured to allow a flow of air to pass therethrough, and that is located between the external fold and the internal fold, and (ii) an internal extension fabric portion that is made from a second, non-mesh flame retardant textile material that is different from the first material, and that extends from the mesh portion to the internal fold;

(e) wherein the proximal fabric layer is interconnected with and made from the same flame retardant textile material as the internal extension fabric portion, the internal fold comprising a defined fold in the flame retardant textile material of the proximal fabric layer and the internal extension fabric portion;

(f) wherein, when the vent is in a closed position, the central venting layer is sandwiched between the flame retardant proximal fabric layer and the flame retardant distal fabric layer; and (g) wherein, when a flame blast is directed toward the vent, the proximal fabric layer and the distal fabric layer are configured to move toward and sandwich the central venting layer to close the vent for preventing the flame blast from entering the flame retardant protective garment through the vent.

2. The flame retardant protective garment of claim 1, further comprising means for securing together the mesh portion and the internal extension fabric portion.

3. The flame retardant protective garment of claim 1, wherein the central venting layer further comprises an external extension fabric portion made from the second, non-mesh flame retardant textile material, the external extension fabric portion extending from the mesh portion to the external fold.

4. The flame retardant protective garment of claim 3, further comprising means for securing together the mesh portion and the internal extension fabric portion; and further comprising means for securing together the mesh portion and the external extension fabric portion.

5. The flame retardant protective garment of claim 3, wherein the distal fabric layer is interconnected with and made from the same material as the external extension fabric portion.

6. The flame retardant protective garment of claim 5, wherein the external fold comprises a defined fold in the flame retardant textile material of the distal fabric layer and the external extension fabric portion.

7. The flame retardant protective garment of claim 1, wherein the layers of the vent form an "S" or "Z" shaped cross-sectional configuration, with the proximal fabric layer forming a bottom portion of the cross-sectional configuration, the distal fabric layer forming an upper portion of the cross-sectional configuration, the central venting layer forming a diagonal portion of the cross-sectional configuration, the external fold representing an intersection of the upper portion and the diagonal portion of the cross-sectional configuration, and the internal fold representing an intersection of the lower portion and the diagonal portion of the cross-sectional configuration.

8. The flame retardant protective garment of claim 1, wherein the mesh portion extends a length of between 25 mm and 75 mm in a direction from the external fold toward the internal fold, and wherein the internal extension fabric portion extends a length of between 10 mm and 40 mm from the mesh portion toward the internal fold.

9. The flame retardant protective garment of claim 1, wherein the defined fold shape comprises a pressed fabric fold.

10. The flame retardant protective garment of claim 1, wherein the defined fold shape comprises a glued fabric fold.

11. The flame retardant protective garment of claim 1, wherein the defined fold shape comprises a stitched fabric fold.

12. The flame retardant protective garment having sleeves, and further comprising vents that allow ventilation of the garment, (a) wherein each said vent comprises:
- (i) a flame retardant proximal fabric layer;
- (ii) a central venting layer connected to the proximal fabric layer by an internal fold; and
- (iii) a flame retardant distal fabric layer connected to the central venting layer by an external fold;
- (iv) wherein the central venting layer comprises:
  - (A) a mesh portion that is made from a first flame retardant material, that is configured to allow a flow of air to pass therethrough, and that is located between the external fold and the internal fold, and
  - (B) an internal extension fabric portion that extends between the mesh portion and the internal fold and that comprises a second, non-mesh flame retardant textile material;
- (v) wherein the proximal fabric layer is interconnected with and made from the same material as the internal extension fabric portion, the internal fold comprising a defined fold in the flame retardant textile material of the proximal fabric layer and the internal extension fabric portion;
- (vi) wherein, when the vent is in a closed position, the central venting layer is sandwiched between the flame retardant proximal fabric layer and the flame retardant distal fabric layer; and
- (vii) wherein, when a flame blast is directed toward the vent, the proximal fabric layer and the distal fabric layer are configured to move toward and sandwich the central venting layer to close the vent for preventing the flame blast from entering the flame retardant protective garment through the vent; and (b) wherein a first vent of said vents extends along a right-rear side of the garment, and a second vent of said vents extends along a left-rear side of the garment.

13. The flame retardant protective garment of claim 12, wherein, with respect to each said vent, the central venting layer further comprises an external extension fabric portion, the external extension fabric portion extending from the mesh portion to the external fold.

14. The flame retardant protective garment of claim 13, wherein, with respect to each said vent, the external extension fabric portion is made from the second, non-mesh material.

15. The flame retardant protective garment of claim 13, wherein, with respect to each said vent, the distal fabric layer is interconnected with and made from the same material as the external extension fabric portion.

16. The flame retardant protective garment of claim 15, wherein, with respect to each said vent, the external extension fabric portion is made from the second, non-mesh material.

17. The flame retardant protective garment of claim 16, wherein, with respect to each said vent, the external fold comprises a defined fold in the flame retardant textile material of the distal fabric layer and the external extension fabric portion.

18. The flame retardant protective garment of claim 15, wherein, with respect to each said vent, the external fold comprises a defined fold in the material of the distal fabric layer and the external extension fabric portion.

19. The flame retardant protective garment of claim 18, wherein the layers of the vent form an "S" or "Z" shaped cross-sectional configuration.

20. A flame retardant protective coverall having a lower portion with legs and a top portion with sleeves, and further comprising vents that allow ventilation of the coverall, (a) wherein each said vent comprises:
- (i) a flame retardant proximal fabric layer;
- (ii) a central venting layer connected to the proximal fabric layer by an internal fold; and
- (iii) a flame retardant distal fabric layer connected to the central venting layer by an external fold;
- (iv) wherein the central venting layer comprises:
  - (A) a mesh portion that is made from a first flame retardant material, that is configured to allow a flow of air to pass therethrough, and that is located between the external fold and the internal fold, and
  - (B) an internal extension fabric portion that extends between the mesh portion and the internal fold and that comprises a second, non-mesh flame retardant textile material;
- (v) wherein the proximal fabric layer is interconnected with and made from the same material as the internal extension fabric portion, the internal fold comprising a defined fold in the flame retardant textile material of the proximal fabric layer and the internal extension fabric portion;
- (vi) wherein, when the vent is in a closed position, the central venting layer is sandwiched between the flame retardant proximal fabric layer and the flame retardant distal fabric layer; and
- (vii) wherein, when a flame blast is directed toward the vent, the proximal fabric layer and the distal fabric layer are configured to move toward and sandwich the central venting layer to close the vent for preventing the flame blast from entering the flame retardant protective coverall through the vent; and (b) wherein a first vent of said vents extends along a right-rear side of the top portion of the coverall, a second vent of said vents extends along a left-rear side of the top portion of the coverall, a third vent of said vents extends across a rear mid-portion of a right leg of the lower portion of the coverall, and a fourth vent of said vents extends across a rear mid-portion of a left leg of the lower portion of the coverall.

* * * * *